United States Patent [19]

Finlayson

[11] 4,385,219

[45] May 24, 1983

[54] PUSH BUTTON SWITCH

[75] Inventor: Laurence H. Finlayson, Cambridge, England

[73] Assignee: U.S. Philips Corporation, New York, N.Y.

[21] Appl. No.: 279,298

[22] Filed: Jul. 1, 1981

[30] Foreign Application Priority Data

Jul. 8, 1980 [GB] United Kingdom ..... 8022323

[51] Int. Cl.[3] ..... H01H 3/12

[52] U.S. Cl. ..... 200/159 A; 200/153 LA; 200/153 M; 200/159 R; 200/241; 200/314

[58] Field of Search ..... 200/159 A, 153 M, 314, 200/241, 242, 159 R, 153 LA, 676, 68

[56] References Cited

U.S. PATENT DOCUMENTS 3,751,618 8/1973 Hallerberg ..... 200/159 R
3,835,276 9/1974 Field ..... 200/153 LA
3,902,032 8/1975 Koepke ..... 200/159 A

FOREIGN PATENT DOCUMENTS 2023933 1/1980 United Kingdom ..... 200/159 A

*Primary Examiner*—John W. Shepperd
*Assistant Examiner*—Renee S. Kidorf
*Attorney, Agent, or Firm*—Robert J. Kraus

[57] ABSTRACT

A push button switch including a housing, a depressible plunger spring-urged towards a rest position in the housing, and a pair of cooperating blade springs each fixed at one end and carrying respective electrical contacts at the other end. Each spring has a shoulder which is engageable by a respective shoulder portion of the plunger during depression to cause the springs to move inwardly toward each other such that the respective electrical contacts engage. The plunger includes an integral spacing member located between the blade springs such that the two springs, and hence their respective electrical contacts, are spaced apart by the spacing member when the plunger is in the rest position. The plunger shoulders, blade springs and spacing member combine to provide tactile feedback when the spacing member moves clear of the springs allowing the contacts to engage.

7 Claims, 4 Drawing Figures

PUSH BUTTON SWITCH

BACKGROUND OF THE INVENTION

This invention relates to a push button switch including a housing, a depressible plunger which is spring-urged towards a first, rest position in the housing, and a pair of cooperating blade springs each of which is fixed relative to the housing at one end and free at the other end. Each blade spring carries a respective electrical contact at the free end and has a shoulder which is engageable by a respective portion of the plunger during depression of the plunger to cause the springs to move inwardly towards each other such that the respective electrical contacts engage. The depression force required on the plunger to cause its portions to ride over the shoulders is greater than the depression force required to complete the depression once the portions have ridden over the shoulders. In such a switch, when the plunger engages and starts to move the shoulder in each blade spring, the operator feels an increased resistance to further movement, but after the switching operation has taken place this resistance decreases rapidly and the maximum depression is suddenly reached, so giving a tactile feedback.

Such a switch is known, for example, from the published United Kingdom patent application No. 7845128 (Ser. No. 2023933A), in which the free ends of the blade springs are self-tensioned apart and bear on opposing faces of a cavity or recess in the plunger.

Switches of this type are often very small, for example when used in push button telephone instruments, and the contact gap between the electrical contacts is also very small. If the push button is jolted or subjected to vibration, it is possible that the free ends of the springs may be jerked away from this rest position to such an extent that their contacts touch each other. Further, the magnitude of the tactile feel is dependent upon the self-tension in the springs, hence requiring that the tensions are accurately adjusted during manufacture. Also, the pre-tensioned springs are difficult to insert in the plunger recess during assembly.

SUMMARY OF THE INVENTION

It is an object of the present invention at least to mitigate these disadvantages.

In accordance with the invention a push button switch of the type defined in the opening paragraph hereof is characterised in that the plunger includes an integral spacing member which is located between the blade springs such that the two springs, and hence their respective electrical contacts, are spaced apart by the spacing member when the plunger is in the first position.

This construction thus has a means which is located between the blade springs all the time that the plunger is in its first position and, hence, prevents any accidental coming together of the electrical contacts which may occur in the event of a mechanical shock to the switch.

According to a feature of the invention, the spacing member is so arranged that it continues to space the two springs apart substantially until the instant the portions of the plunger have ridden over the shoulders and, on further depression of the plunger, is then moved clear of the springs. This provision ensures that the electrical contacts are prevented from coming together until a positive decision has been made to actuate the switch and the plunger is depressed; thus helping to prevent accidental operation of the switch. It also provides a "stiffer" feel to the switch and, hence, increases the tactile feedback.

The spacing member may be so shaped that during depression of the plunger, but before its portions ride over the shoulders, one of the blade springs is allowed to move towards the other, the other blade spring being held stationary by the spacing member during said movement. This arrangement allows the final coming together of the electrical contacts to occur with a wiping action which serves to keep the contacts clean and promotes reliable oeration.

Conveniently, each said portion of the plunger is a ramp formed in an internal recess of the plunger. This construction helps to reduce wear in the switch and gives a smoother operation as compared with an angled shoulder.

BRIEF DESCRIPTION OF THE DRAWING

By way of example, embodiments of the invention will now be described with reference to the accompanying drawings, in which.

DESCRIPTION OF THE PREFERRED EMBODIMENTS

Figure 1:
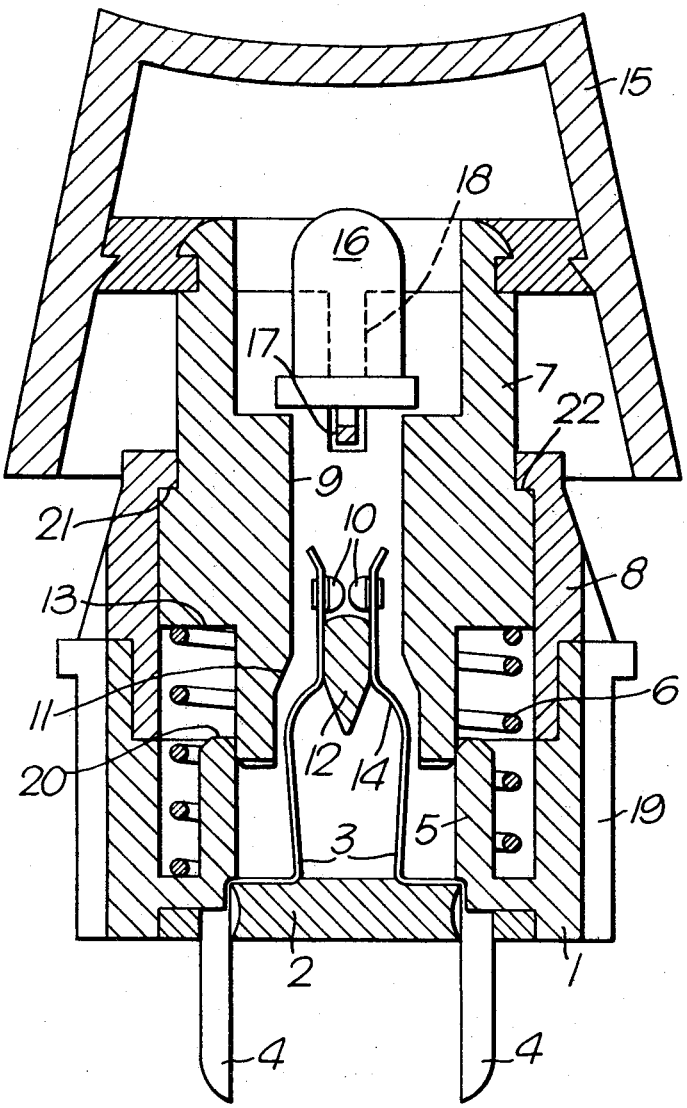
FIG. 1 is a vertical cross-sectional view of the push button switch.

The switch comprises a lower housing part 1, a base insert 2 and two blade springs 3. The blade springs 3 are secured to the lower housing part 1 by being trapped between the lower housing part 1 and the base insert 2 when these two components are joined together. Each blade spring 3 has a corresponding contact pin 4 by which the switch can be secured to and electrically connected with a printed circuit board.

The lower housing part 1 has an annular section 5 which is surrounded by a coil spring 6. Within the annular section 5, a plunger 7 is able to move in a sliding manner and the plunger 7 is urged upwards into a first position by the spring 6. The plunger 7 is secured in the lower housing part 1 by an upper housing part 8 which is adapted for snap fitting into the lower housing part.

The plunger 7 may have a round or a generally square shape in a plane normal to the axis of movement thereof. The plunger 7 is provided with a hollow internal recess 9 in which the free ends of the blade springs 3 are positioned. The lower section of the plunger 7 is annular and the internal recess 9 is so shaped as to have two shoulders in the form of ramps 11. Integral with the plunger and between the two ramps 11 is a central spacing member 12.

The blade springs 3 have shoulder portions 14 which engage with the ramps 11 of the plunger 7 during depression of the plunger. Each blade spring 3 carries an electrical contact 10.

The embodiment of the switch shown in FIG. 1 is also provided with a light-transmissive cap button 15 located on top of the plunger and an indicator lamp 16 which is accommodated adjacent the plunger 7. Electrical leads 17 of the lamp are led out horizontally from the base of the lamp and then pass through slots 18 in the plunger and along channels corresponding to channels 19 in the upper and lower housing parts so that they may be connected to the printed circuit board. During depression of the plunger 7 the lamp 16 is not affected by this movement and the lamp remains in its original position with respect to the printed circuit board supported by the leads 17. This provision avoids any need for the electrical leads 17 of the lamp to suffer any bending force in response to movement of the plunger of the switch. The lamp 16 is a light-emitting diode.

In operation of the push button switch, the plunger 7 is initially in the first position depicted in FIG. 1 with the blade springs 3 carrying the contacts 10 in a normally open condition. The blade springs 3 are tensioned so as to be in contact with the spacing member 12. Depression of the plunger 7 causes the spacing member 12 to move downwards between the blade springs 3 and simultaneously the ramps 11 are brought into contact with the shoulder portions 14. Moving the blade springs 3 inward.

Figure 2:
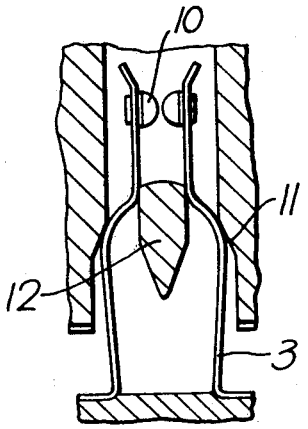
FIGS. 2 and 3 are details showing different stages in the operation of the switch.
Figure 3:
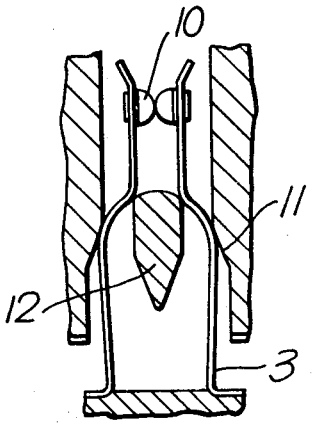

FIG. 2 shows the plunger 7 with the ramps 11 just beginning to contact the shoulder portions 14. FIG. 3 shows the ramps 11 having moved further down the shoulder portions 14 and the spacing member 12 moving sufficiently to allow the blade springs 3 to come together and the electrical contacts 10 to touch. In this position, the ramps 11 can apply a maximum inwardly-directed force to the blade springs 3.

The mechanical operation of the switch is arranged to provide a tactile feedback to the operator. This is made possible by the movement of the plunger 7 offering only slight resistance until the point when the ramps 11 meet the shoulder portions 14. Continued pressure then causes the blade springs 3 to tend to move inward, but the position of the spacing member 12 in relation to the positions of the ramps 11 and shoulder portions 14 is such that this movement is prevented. The force now required to operate the switch is such that the operator is required to increase the pressure applied to the plunger to overcome the resistance of the ramps 11 of the plunger forcing the blade springs 3 against the spacing member 12.

As the plunger is depressed further, the ramps 11 slide over the shoulder portions 14 at the same instant that the spacing member 12 clears the blade springs 3 permitting the electrical contacts 10 to move rapidly together.

Further depression of the plunger 7 can take place with only a minimum amount of applied force and the downward movement is terminated by the lower side 13 of the plunger coming up against the upper edge 20 of the section 5.

When the operating force is removed from the plunger 9, the spring 6 pushes the plunger up to the first position and the electrical contacts 10 are opened. The upward movement is terminated by an edge 21 of the plunger meeting a lip 22 of the upper housing part 8.

The switch therefore has a tactile feedback that makes the operator aware that the required switching operation has taken place.

Figure 4:
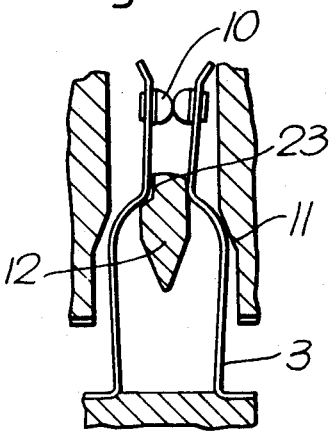
FIG. 4 is a view similar to FIG. 3 showing a different embodiment.

FIG. 4 is a view similar to those of FIGS. 2 and 3 where, in a different embodiment, the spacing member has at one side a groove 23. The view shows the plunger in the partially depressed condition before the ramps 11 have made contact with the shoulder portions 14 of the blade springs 3. The left hand blade spring 3 has entered the groove 23 of the spacing member 12 and the spring tension present in this blade spring has allowed the upper part of the blade spring and hence its associated electrical contact, to move towards the right bringing its electrical contact 10 up against, or at least close to, the electrical contact of the right hand blade spring.

As the spacing member 12 moves out of contact with the blade springs 3, the electrical contact 10 carried by the right hand blade spring pushes against the left hand electrical contact with a wiping action and the two blade springs 3 move to arrange themselves symmetrically about the centre line of the recess 9. The wiping action which takes place across the faces of the electrical contacts 10 ensures that the faces remain clean so that good electrical continuity is present when the contacts 10 are in their final position for the "make" condition of the switch.

The foregoing description of an embodiment of the invention has been made by way of example only and a number of modifications may be made without departing from the scope of the invention as defined in the appended claims. For instance, it is not essential that the switch should be designed for mounting on a printed circuit board. For example the switch could be arranged for screw attachment to a front panel. The external electrical connections to the contact pins 4 could also be made by other means such as by push-on connectors.

In some cases, for example when the switches are used on push-button telephone instruments, it is not necessary to illuminate the cap button 15. In such cases lamp 16 would be omitted and cap button 15 may be of a suitably coloured opaque material.

Instead of being domed, contacts 10 may alternatively be formed by a layer of contact material, such as a silver-gold alloy formed or deposited on the blade springs.

The lamp 16 may alternatively be a filament lamp.

I claim:

1. A push button switch including:

(a) a housing;

(b) a depressible plunger movably mounted in the housing and resiliently urged toward a rest position, said plunger having a pair of shoulders;

(c) a pair of blade springs mounted in the housing with one end of the pair being fixed and the other free, the free end of each blade spring carrying a respective electrical contact, each spring blade having a shoulder for engagement with a respective one of the shoulders of the plunger during depression, to effect movement of the spring blades toward each other;

(d) a spacing member disposed between the blade springs for keeping the blade springs and their respective contacts separated when the plunger is in the rest position, said spacing member being arranged for movement with the plunger;

said plunger shoulders, blade springs and spacing member being positioned relative to each other such that during depression of the plunger the spacing member continues to separate the spring blades until after the plunger shoulders engage the spring blade shoulders, thereby increasing the resistance to movement of the plunger, and then said spacing member moves clear of the spring blades suddenly decreasing the resistance to movement and enabling the contacts to come together.

2. A push button switch as in claim 1 where said spring blades are self-biased toward each other.

3. A push button switch as in claim 2 where said spacing member is shaped such that, during depression of the plunger but before its shoulders engage the spring blade shoulders, one of the blade springs is allowed to move toward the other, said other blade spring being held stationary by the spacing member during such movement.

4. A push button switch as in claim 1, 2 or 3 where the shoulders of the plunger are ramps formed in an internal recess of the plunger.

5. A push button switch as in claim 1, 2 or 3 and further including a cap button removably secured to the plunger.

6. A push button switch as in claim 5 and further including a lamp disposed within the plunger but fixed to the housing such that the lamp remains fixed relative to the housing during depression of the plunger, said cap button having a light transmissive portion.

7. A push button switch as in claim 6 where said lamp is a light emitting diode.

* * * * *